US008696484B2

(12) United States Patent
Shahi et al.

(10) Patent No.: US 8,696,484 B2
(45) Date of Patent: Apr. 15, 2014

(54) GOLF AID

(76) Inventors: Sean Shahi, Laguna Niguel, CA (US); Peter Shahi, Laguna Niguel, CA (US)

( * ) Notice: Subject to any disclaimer, the term of this patent is extended or adjusted under 35 U.S.C. 154(b) by 0 days.

(21) Appl. No.: 13/544,992

(22) Filed: Jul. 9, 2012

(65) Prior Publication Data

US 2013/0178302 A1 Jul. 11, 2013

Related U.S. Application Data

(60) Provisional application No. 61/505,370, filed on Jul. 7, 2011.

(51) Int. Cl.
*A63B 69/36* (2006.01)

(52) U.S. Cl.
USPC ..... 473/257; 473/273; 473/409

(58) Field of Classification Search
USPC ..... 473/218, 257, 261–273; 403/174, 230, 403/292, 294, 300, 305, 309
See application file for complete search history.

(56) References Cited

U.S. PATENT DOCUMENTS

| | | | | |
|---|---|---|---|---|
| 4,322,084 | A * | 3/1982 | Reece et al. | 473/273 |
| 4,925,192 | A * | 5/1990 | Forbes | 473/273 |
| 7,037,210 | B2 * | 5/2006 | Bainter | 473/270 |
| 7,431,661 | B1 * | 10/2008 | Cailey | 473/257 |
| 7,607,987 | B2 * | 10/2009 | Alter | 473/218 |
| 7,922,598 | B1 * | 4/2011 | Karpyak et al. | 473/272 |
| 2003/0220151 | A1 * | 11/2003 | Bainter | 473/270 |

* cited by examiner

*Primary Examiner* — Nini Legesse
(74) *Attorney, Agent, or Firm* — Kafantaris Law Offices; Theo Kafantaris

(57) ABSTRACT

A golf aid is disclosed for providing a unique method of aiming and aligning a golf shot. The golf aid comprises an elongated base having a plurality of apertures and a plurality of elongated rods adapted to fit within the apertures. By inserting the elongated rods into the apertures in a pre-determined orientation, the present invention can assist the golfer with aiming, alignment, swing mechanics, backswing accuracy, follow-through accuracy, opening/closing their stance, and more.

19 Claims, 14 Drawing Sheets

GOLF AID

CROSS-REFERENCE TO RELATED APPLICATIONS

This application claims the benefit of U.S. Provisional Patent Application No. 61/505,370, filed on Jul. 7, 2011, and incorporated herein by reference.

STATEMENT REGARDING FEDERALLY SPONSORED RESEARCH AND DEVELOPMENT

Not Applicable.

FIELD OF THE INVENTION

This invention relates generally to a golf aid, and more particularly, to an apparatus that aids in aiming and aligning a golf swing.

DISCUSSION OF RELATED ART

Golf is an outdoor sport in which competing players use several different types of clubs to strike a ball into a hole. Golf is played on a golf course where players navigate through fairways and greens and try to avoid roughs, trees, water traps, sand traps, and other obstacles. The ultimate goal of the game is to hit a golf ball into a designated hole in as few strokes as possible.

Golf is an incredibly challenging and precise game. The golf ball, weighing less than two ounces and measuring less than 2 inches in diameter, must travel hundreds of yards while avoiding intentionally placed obstacles to ultimately land in a golf hole a mere 4.25 inches in diameter. Wind, spin, power, club selection, aim, and technique all contribute greatly to the success or failure of a swing. It is no surprise that concentration and patience are critical for a successful golf game.

Golfing lessons have become increasingly popular as the game of golf, in general, becomes more mainstream. Furthermore, golf training aids have become more robust, enabling golfers to work on their stroke without the help of a professional.

While golf training aids are becoming more robust, there is currently no training aid that can assist a golfer in aligning their shot, aligning their swing, or positioning their head, shoulders, and feet, all in a single device. Therefore, a need exists for a robust golf training and alignment aid that can assist golfers in various aspects of their golf game. The present invention accomplishes these objectives.

SUMMARY OF THE INVENTION

The present invention will provide a robust golf training and alignment aid that can assist golfers in various aspects of their golf game. Furthermore, the present invention will be easily packaged and carried with the user in their golf bag for use anytime. This is accomplished by creating a sturdy base with several marked holes where elongated rods can be inserted.

The frame comprises a hollow rectangular base with several marked holes. The holes are designated with different colors corresponding to their different uses. The elongated rods, which are stored inside of the base, are then inserted in the holes to help the golfer aim his or her shot. Alternate holes can be used to help the golfer align their feet, shoulders, and head placement, as well as check stroke technique.

When aligning a shot, the hole, ball, and striking spot must be parallel, creating an imaginary target line. The golfer's feet, knees, hips, and shoulders must all be aligned properly in the stance in order to strike the ball along the desired target line. When golfing, the aid will assist the golfer in aligning their shot and properly striking the ball to ensure it will travel along the target line toward the hole.

These and other objectives of the present invention will become obvious to those of ordinary skill in the art after reading the following detailed description of the preferred embodiments. It is to be understood that the foregoing general description and the following detailed description are exemplary, and are intended to provide further explanation of the invention as claimed.

DETAILED DESCRIPTION OF THE PREFERRED EMBODIMENT

Figure 1:
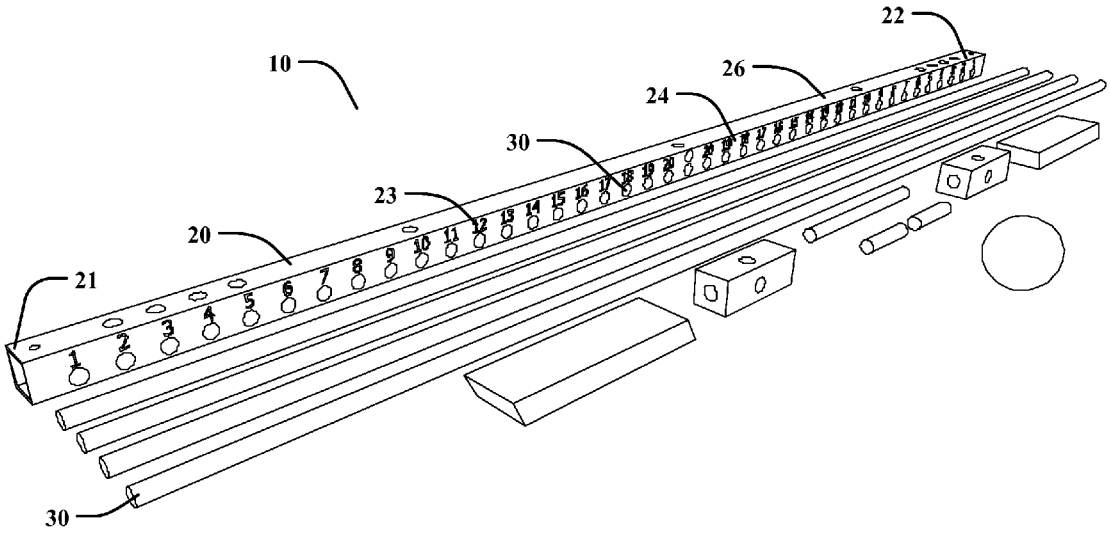
FIG. 1 is a front perspective view of the golf aid.
Figure 2:
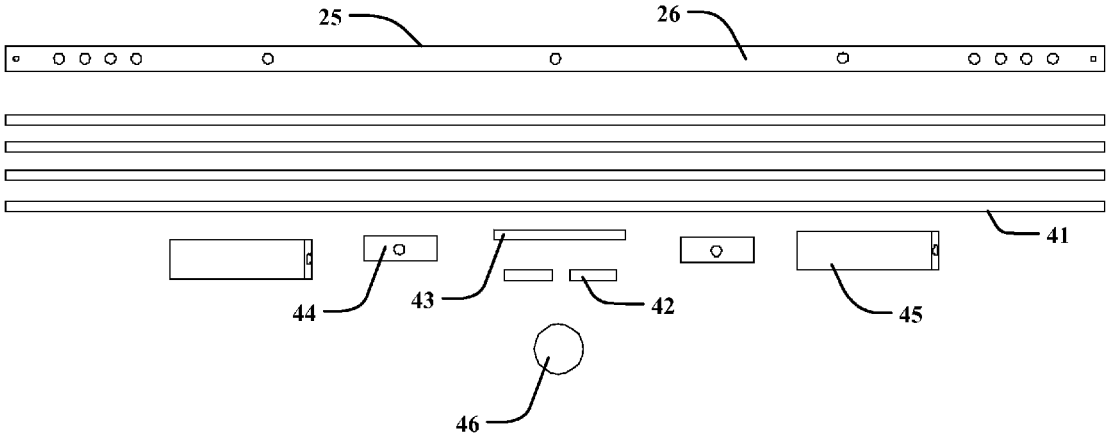
FIG. 2 is a top view of the golf aid.
Figure 3:
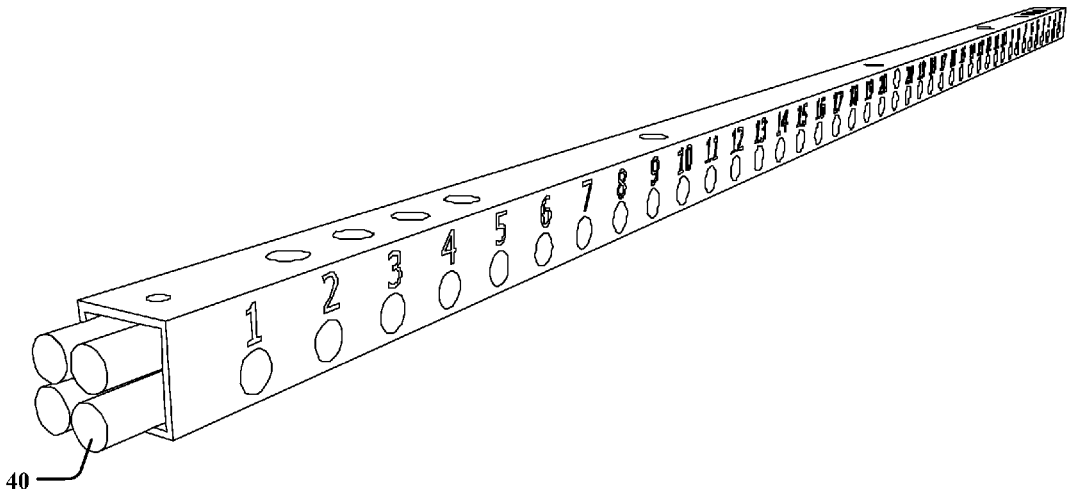
FIG. 3 is a perspective view of the base.
Figure 4:
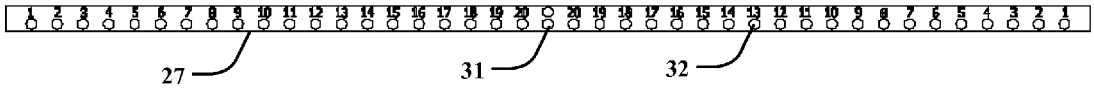
FIG. 4 is a front view of the base.
Figure 5:
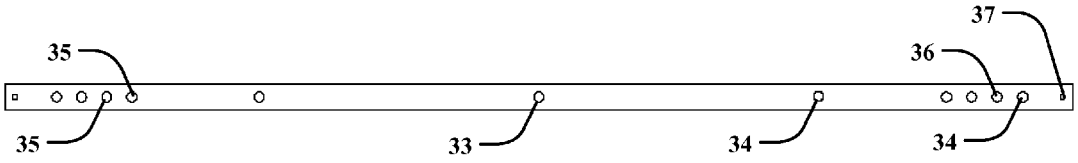
FIG. 5 is a top view of the base.
Figure 6:
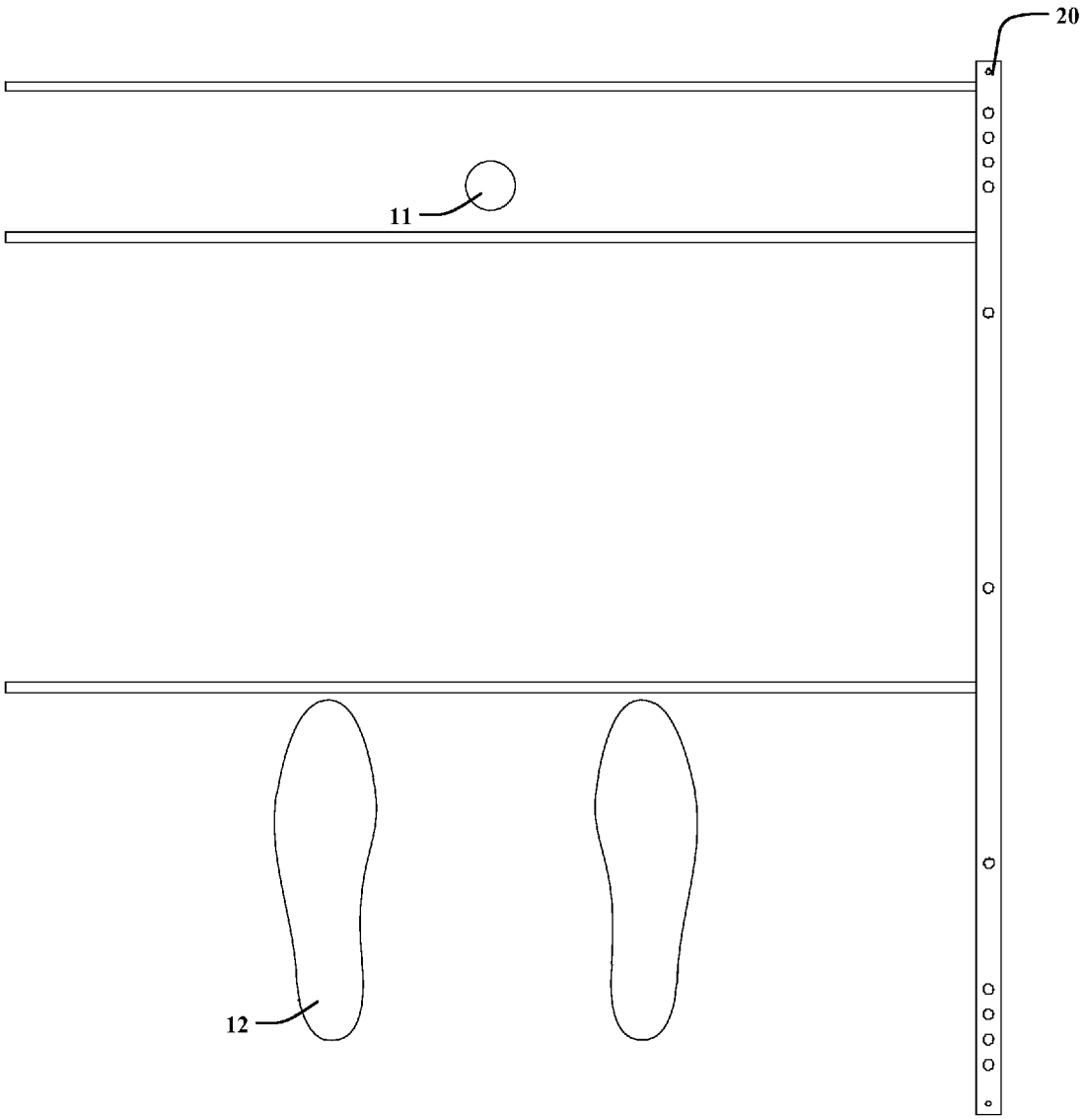
FIG. 6 is a top view of the alignment method.
Figure 7:
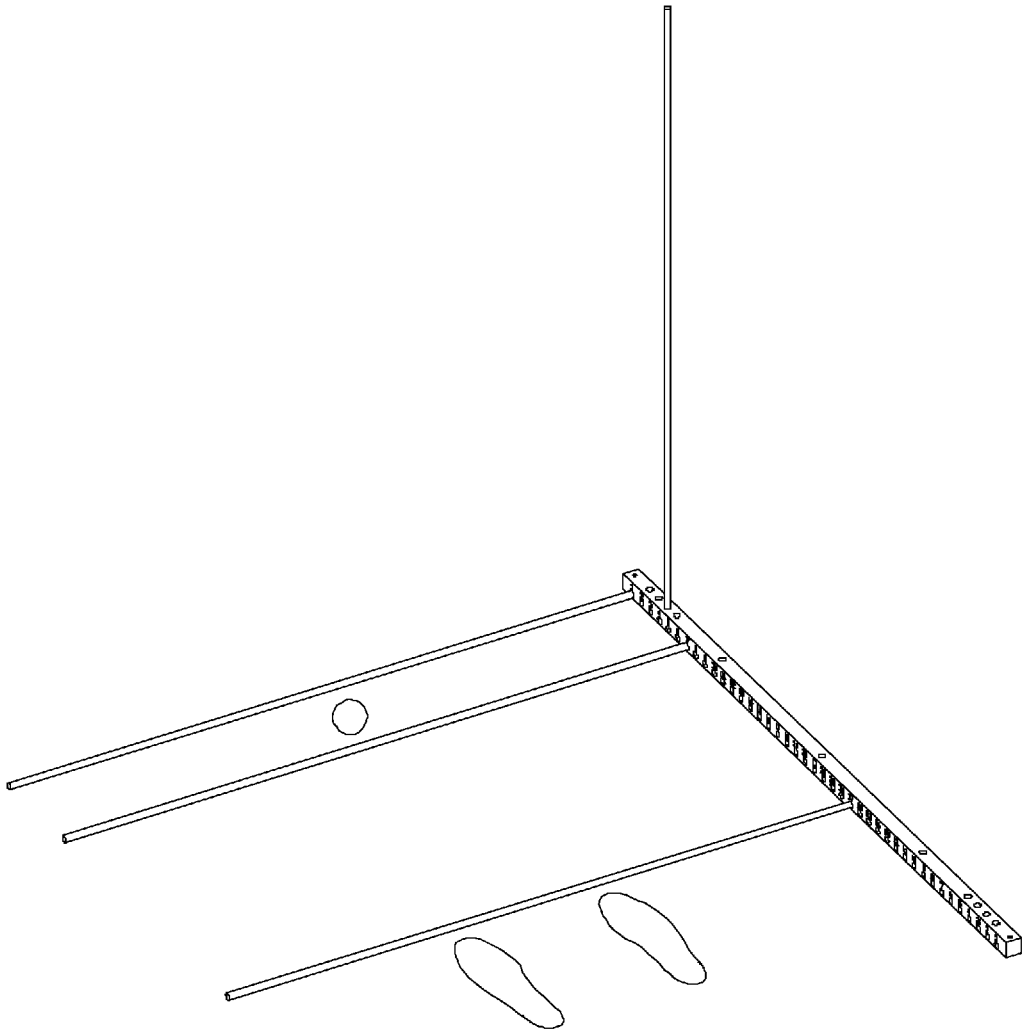
FIG. 7 is a perspective view of the alignment method with aiming rod.
Figure 8:
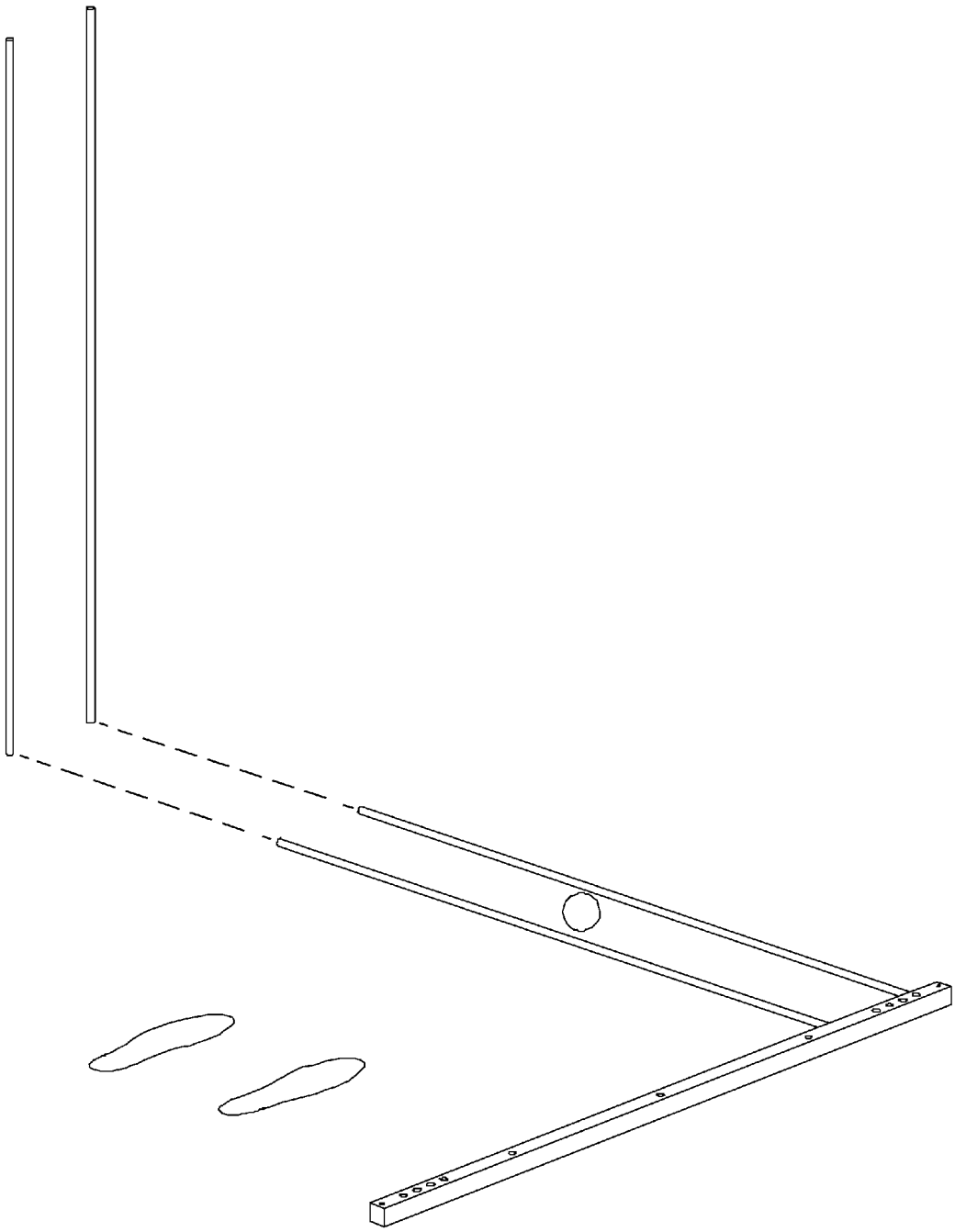
FIG. 8 is a top view of the alignment method with forward aim rods.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention 10 comprises a lightweight, yet sturdy, elongated shaft 20, or base, with a hollow center. The base 20 is rectangular, having a proximal end 21, a distal end 22, opposing parallel front and rear faces 24, 25, and opposing parallel top and bottom faces 26, 27, although any suitable shape can be used without departing from the spirit of the invention. The base 20 comprises a plurality of apertures 30 positioned on each face, with markings 23 relating to the usage of the apertures 30. Unless otherwise defined, each aperture 30 extends perpendicular to the face it is associated with. The base 20 may be made from plastic, metal, wood, graphite, or any other suitable material, and may include a soft or rubberized coating for comfort and protection.

The base 20 is open on its proximal end 21 and closed on its distal end 22. A plurality of elongated rods 40 are adapted to fit within the apertures 30 and adapted to be stored within the base 20 by inserting the elongated rods 30 into the proximal (open) end 21 of the base 20. When in use, a golfer will bring the golf aid 10 to the course or training area, align the base 20, remove the elongated rods 40 from the base 20, and insert them into the apertures 30 in a predetermined configuration to help aim and align a golf shot. In order to accommodate left and right-handed golfers, the base 20 is symmetrical about a line of symmetry 28 at the center of the base 20.

In the preferred embodiment, the elongated rods 40 comprise four elongated rods 41, two connecting rods 42, and one combination rod 43. The alignment rods 41 each have markings to assist in alignment, with a center point designating where the ball will be placed, and a separate section designating where the swing should be made. Furthermore, a pair of rectangular connectors 44 having a plurality of through holes are provided for connecting the elongated rods 40 and accessories together. A pair of tapered foam members 45 are adapted to connect to the rectangular connectors 44 using elongated rods 40. Lastly, a positioning ball 46 is adapted to connect to the elongated rods 40 directly, or to the rectangular connectors 44 using the connecting rods 42.

The golf aid 10 comprises several apertures 30, each corresponding to a specific method of use defined below. A front aperture 31 is positioned at the center of the front face 24 and continues through the front and rear faces 24, 26, creating a through hole. This front aperture 31 is primarily used to balance the golf aid 10 in certain configurations. Two sets of 20 equidistant alignment apertures 32 are also on the front face 24, with each set positioned on opposing sides of said front aperture 31. The alignment apertures 32 are numbered for reference and customization with markings 23 for advanced use.

A top aperture 33 is positioned at the center of the top face 26. The top aperture 33 has an angle of incidence between 30° and 60° towards the front face 24. Two pairs of backswing apertures 34 are positioned on opposing sides of the top aperture 33, each backswing aperture 34 having an angle of incidence between 30° and 60° towards the top aperture 33. The backswing apertures 34 are generally positioned above alignment apertures 32 two and ten, although this configuration can be adjusted. Two pairs of aiming apertures 35 are also positioned on opposing sides of the top aperture 33, generally positioned above markings four and five. Furthermore, two chipping apertures 36 are positioned on opposing sides of said top aperture 33, each chipping aperture 36 having an angle between 30° and 60° towards said rear face 25 and positioned generally above marking three. Lastly, two golf tee apertures 37 are positioned on opposing sides of the top aperture 33, each golf tee aperture 37 continuing through the top and bottom faces 26, 27 and adapted for driving a pair of golf tees through the elongated body 20 and into the ground for stability.

Each group of apertures 30 is associated with a color, with each color corresponding to a configuration for using the golf aid. A first color corresponds with the alignment and aiming apertures 31, 35, a second color with the backswing apertures 34, a third color with the chipping apertures 36 and a subset of the alignment apertures 31, a fourth color with the golf tee apertures 37, and a fifth color with the front and top apertures 31, 33. By color coding the apertures 30, users can quickly and easily convert the configuration of the golf aid 10. Suitable colors include red, yellow, green, orange, and blue, although any color can be used.

Figure 9A:
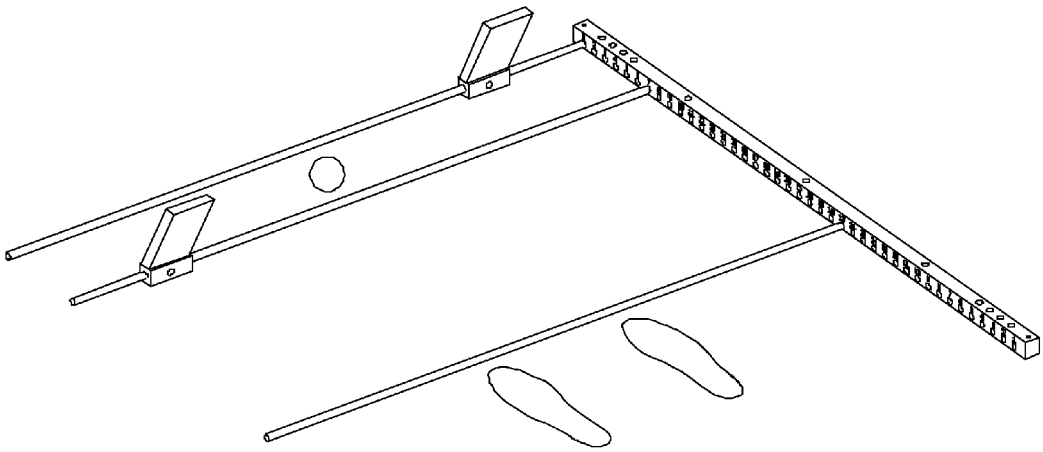
FIG. 9A is a perspective view of the swing path check method.
Figure 9B:
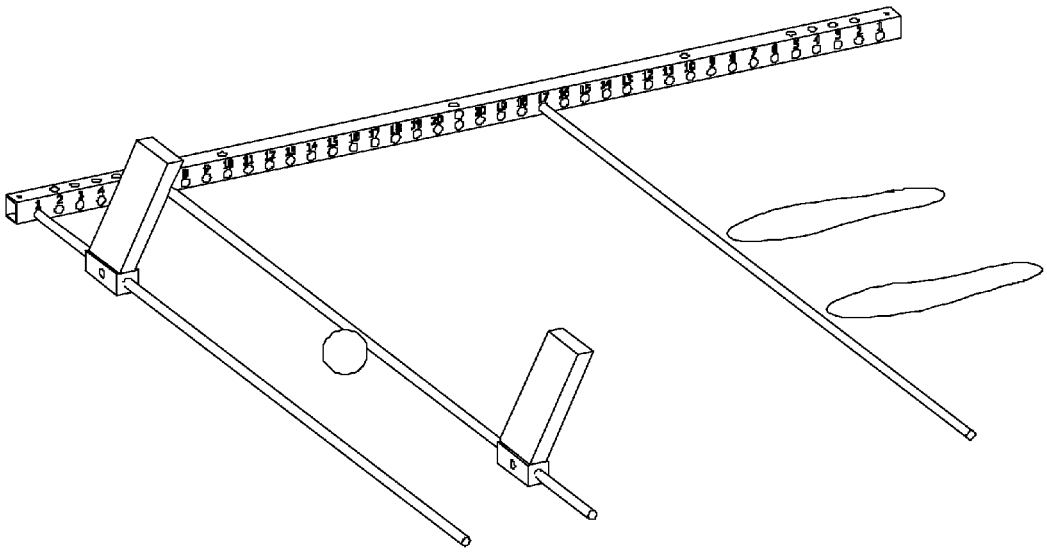
FIG. 9B is a perspective view of the swing path check method.
Figure 10A:
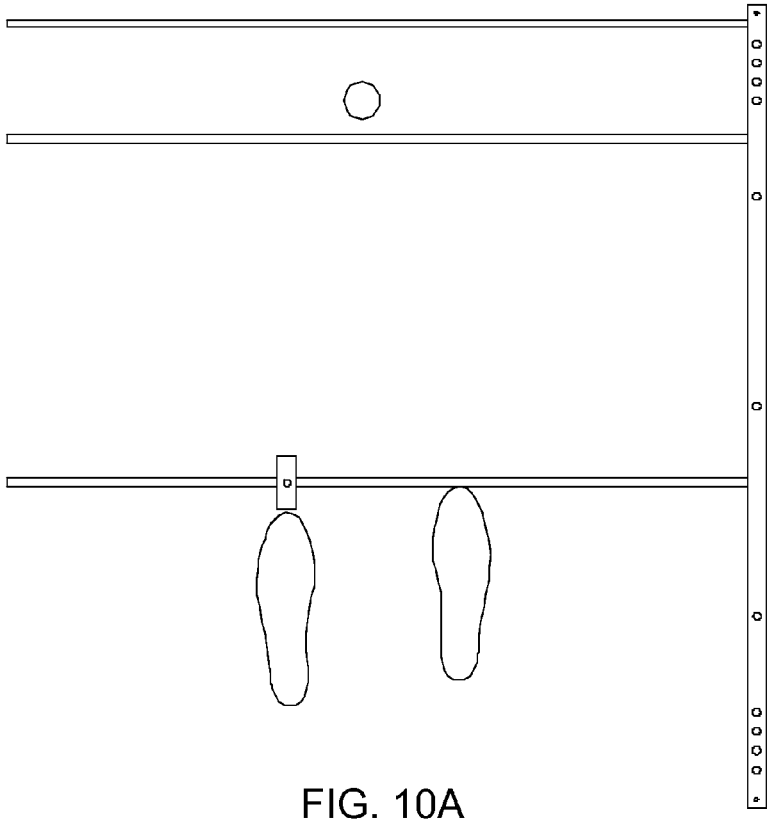
FIG. 10A is a top view of the draw/fade method.
Figure 10B:
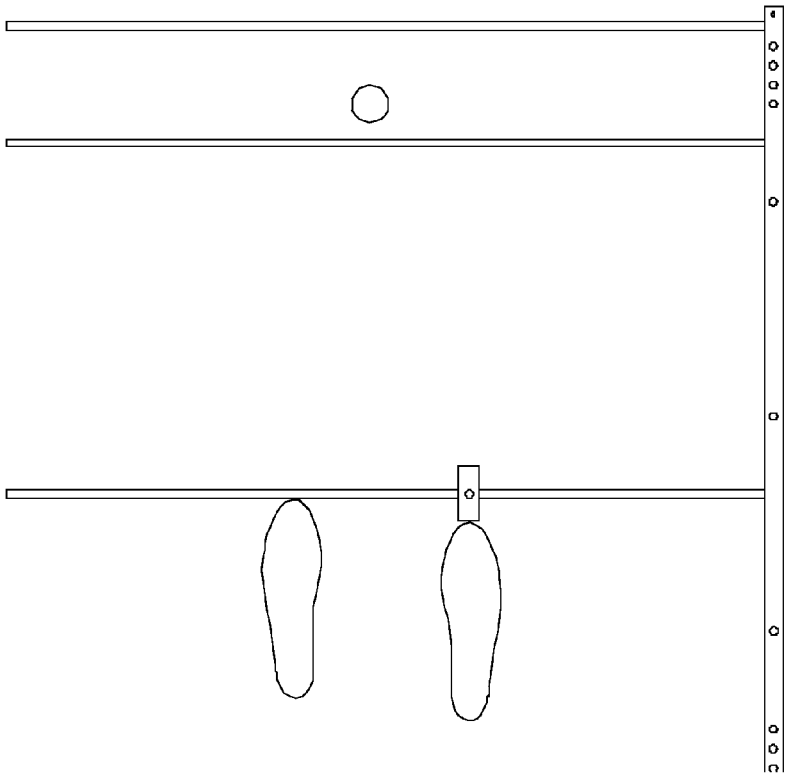
FIG. 10B is a top view of the draw/fade method.
Figure 11:
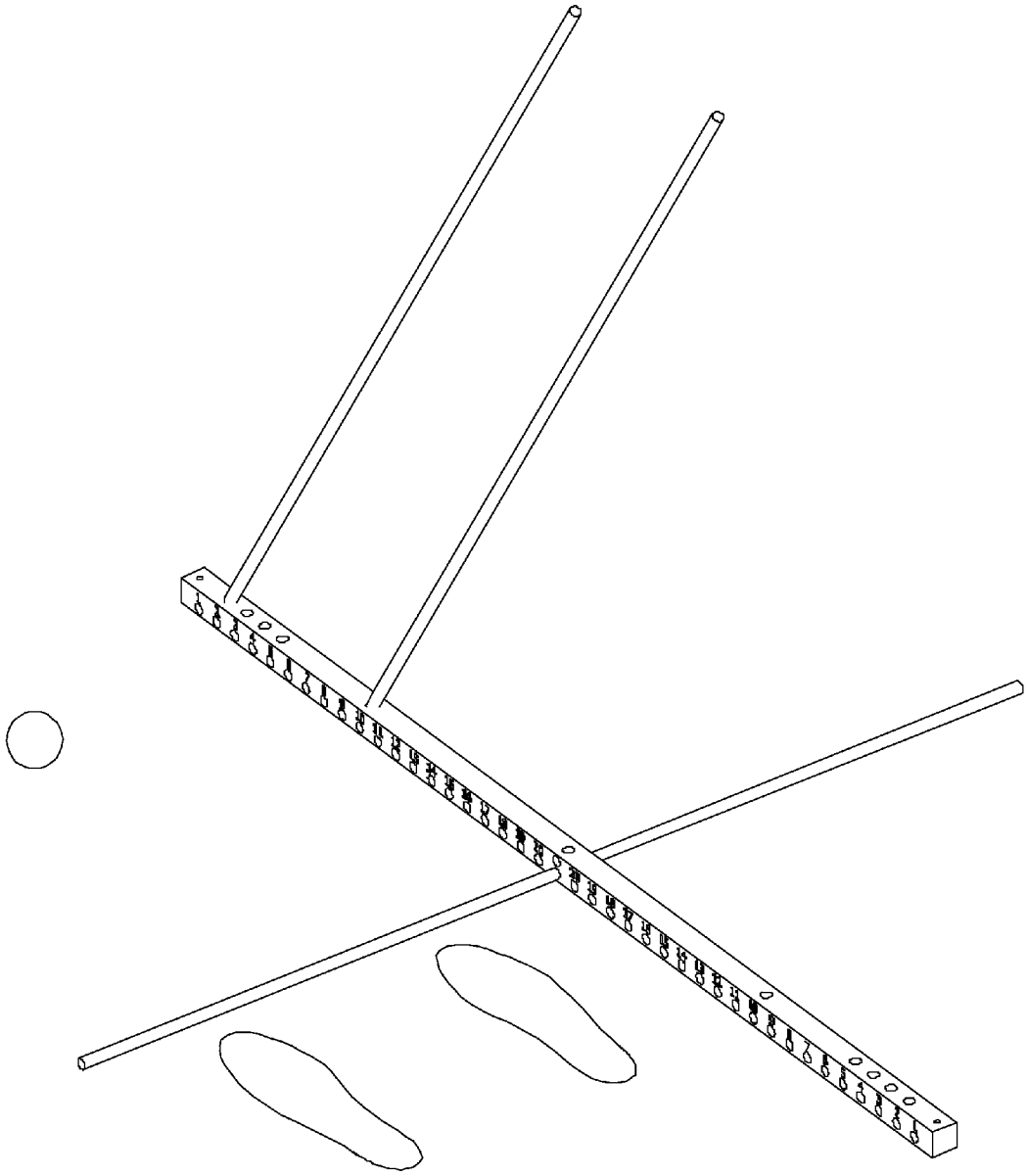
FIG. 11 is a perspective view of the swing plane method.
Figure 12A:
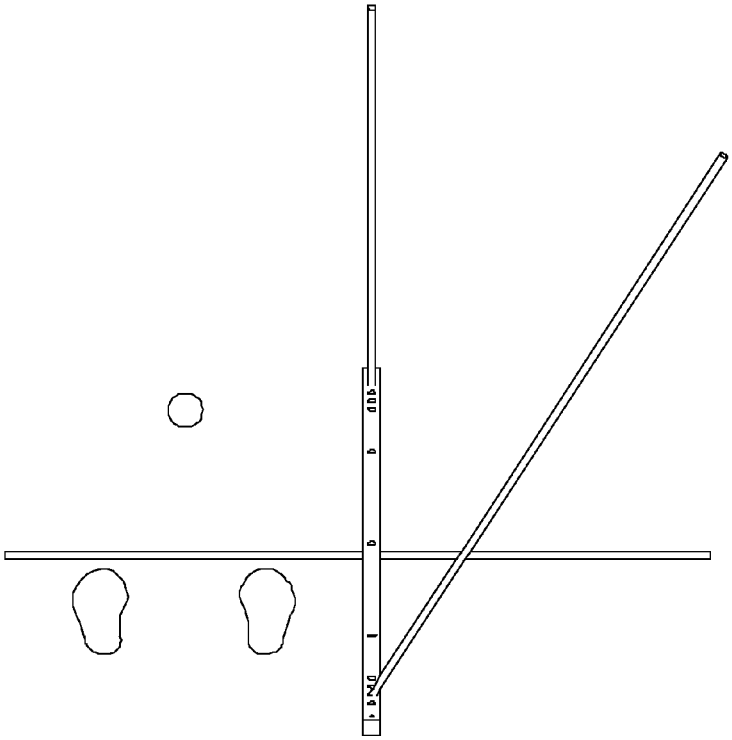
FIG. 12A is a front view of the chipping plane method.
Figure 12B:
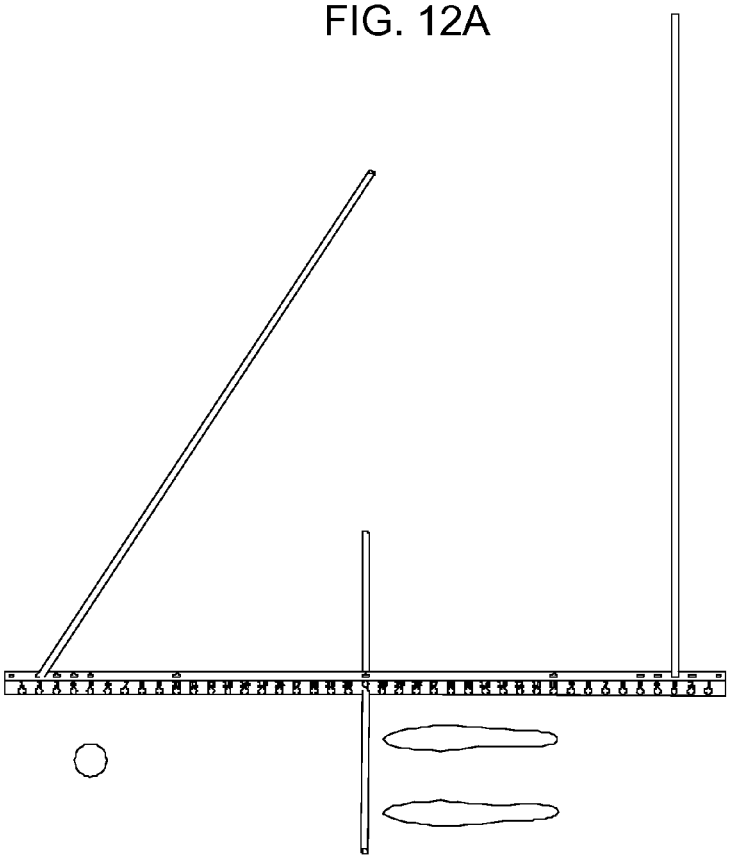
FIG. 12B is a side view of the chipping plane method.
Figure 13:
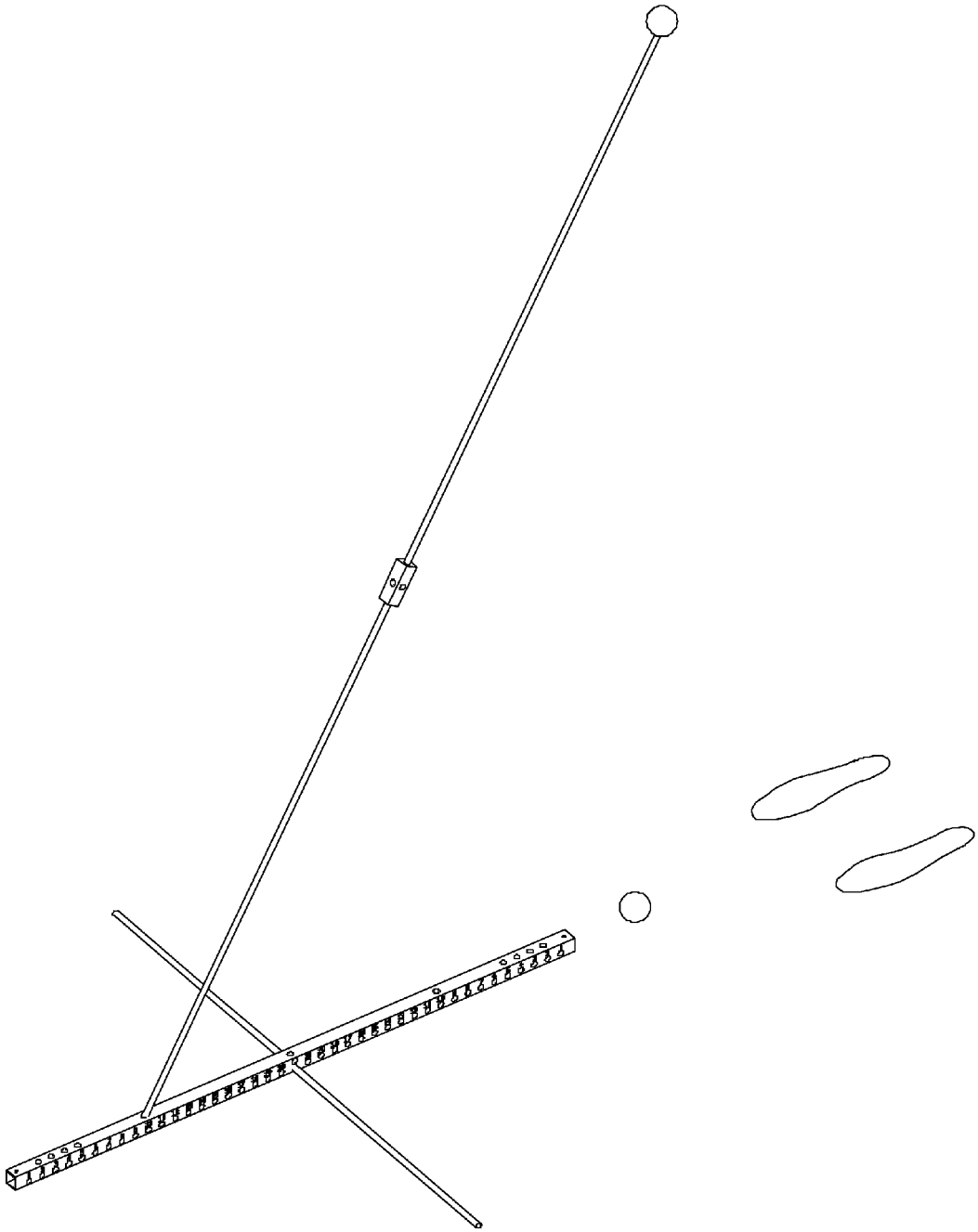
FIG. 13 is a perspective view of the head alignment method.
Figure 14:
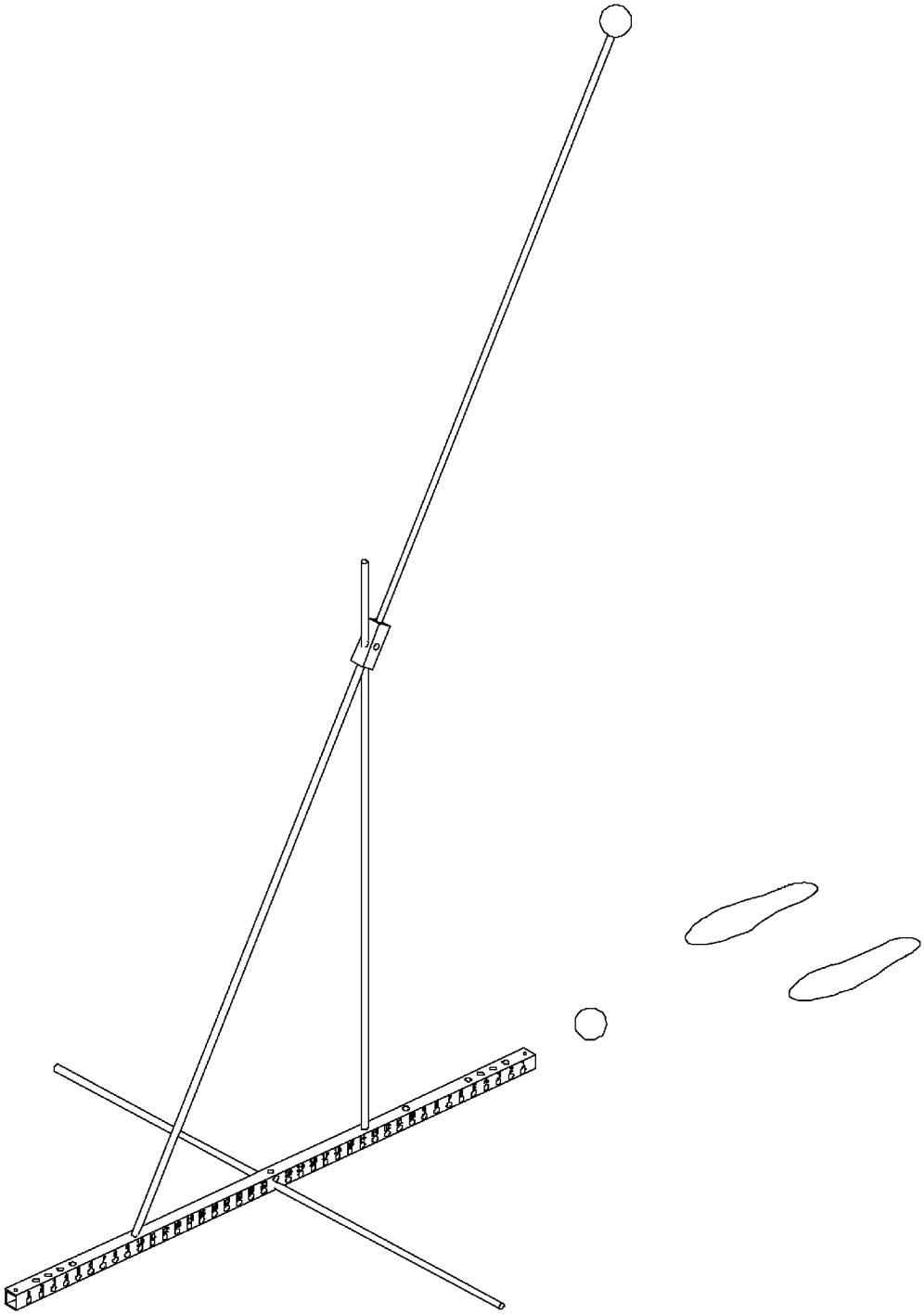
FIG. 14 is a perspective view of the head alignment method with additional vertical support.
Figure 15:
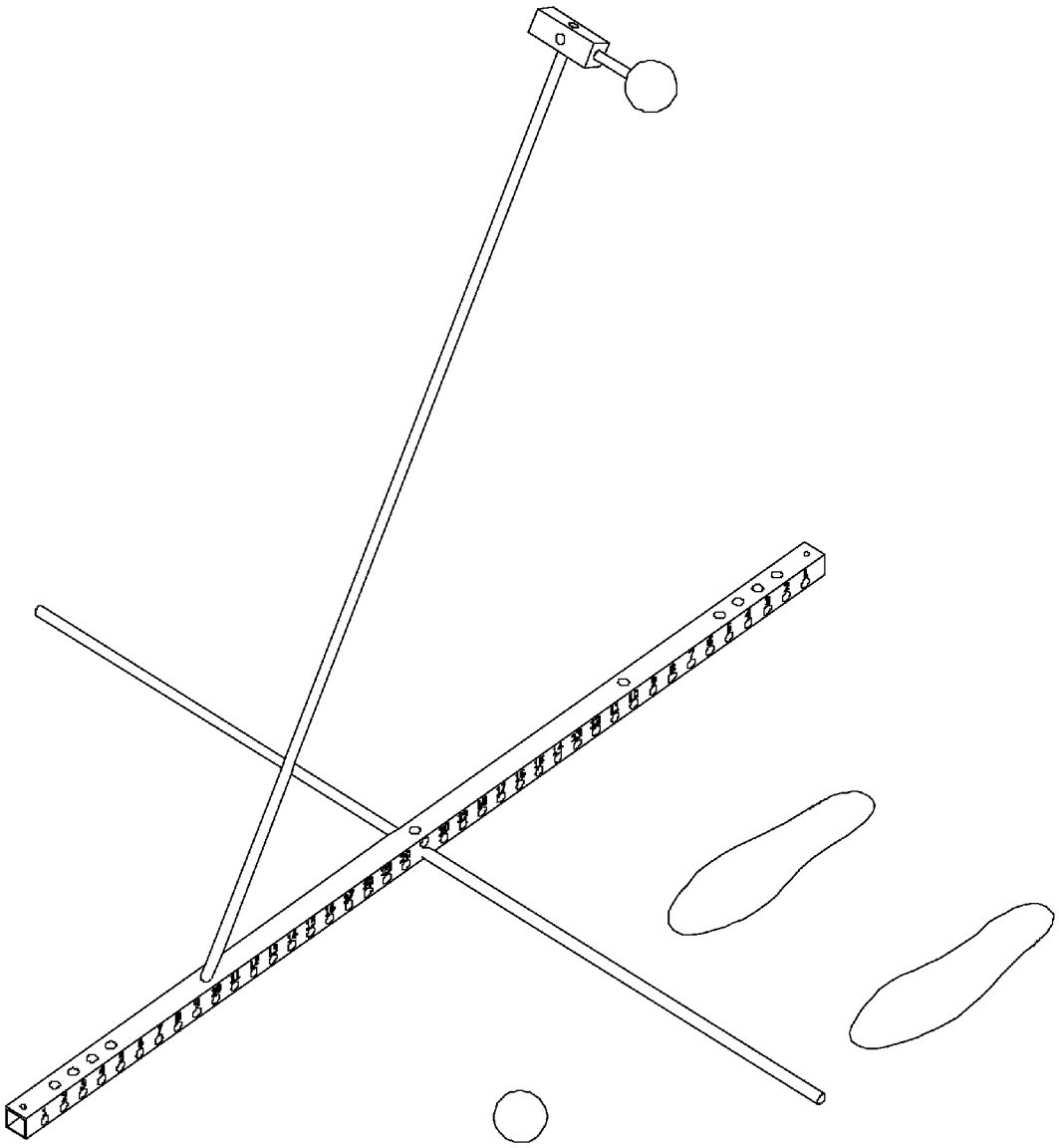
FIG. 15 is a perspective view of the anti-sway method.
Figure 16:
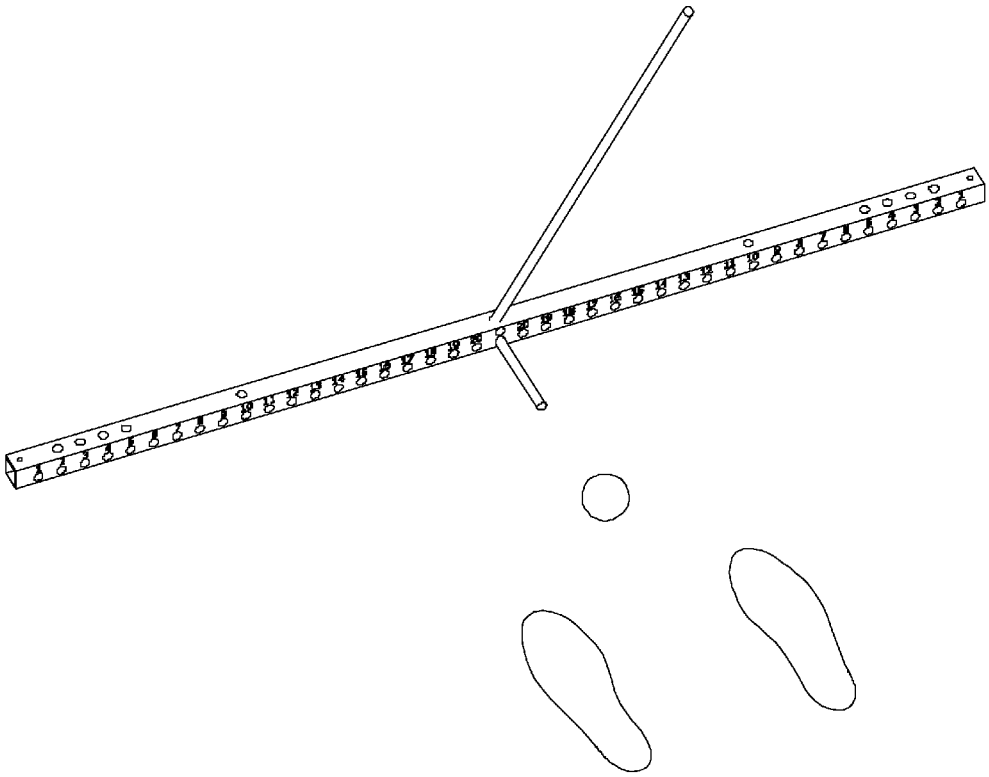
FIG. 16 is a perspective view of the inside approach method.
Figure 17:
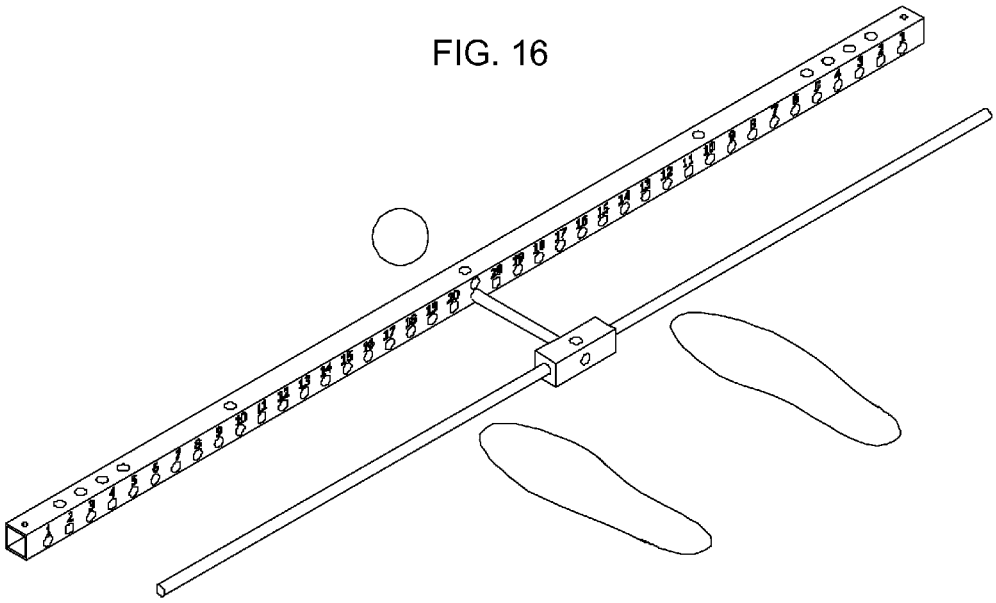
FIG. 17 is a perspective view of the putting alignment method.
Figure 18:
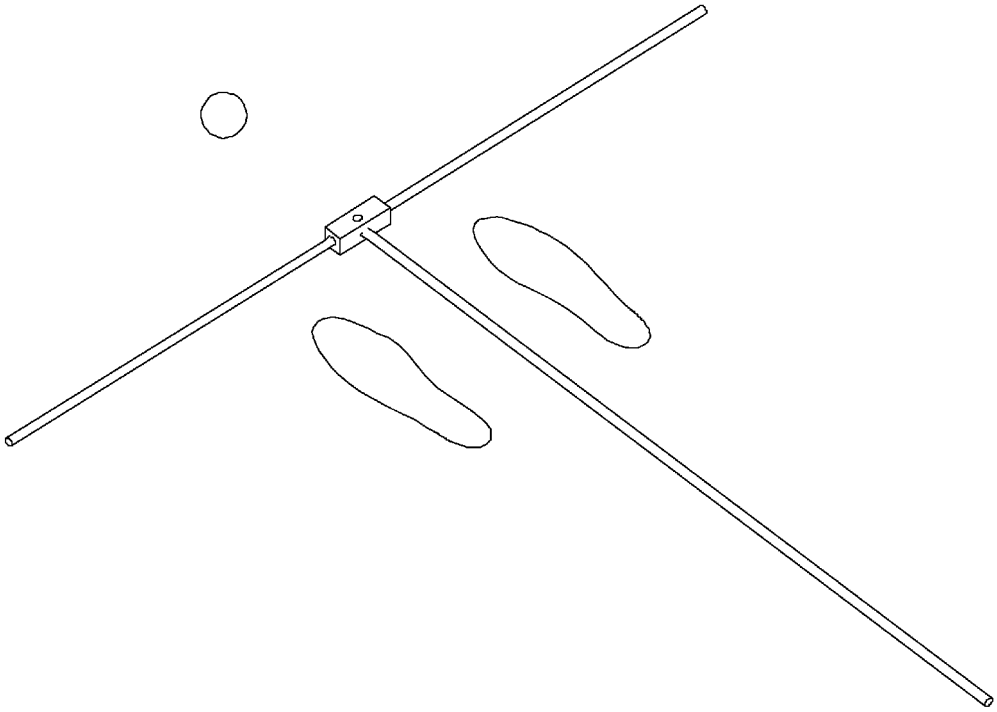
FIG. 18 is a perspective view of the alignment method according to an alternative embodiment.

The present invention 10 comprises several configurations, or methods of use; an alignment method (FIGS. 6-8, 18), a swing path check method (FIGS. 9A, 9B), a draw/fade method (FIGS. 10A, 10B), a swing plane method (FIG. 11), a chipping plane method (FIGS. 12A, 12B), a head alignment method (FIGS. 13, 14), an anti-sway method (FIG. 15), an inside approach method (FIG. 16), and a putting alignment method (FIG. 17). Each method comprises placing the elongated rods 40 and other accessories into pre-designated apertures 30 corresponding with a color. In the preferred embodiment, instructions for use will be printed on the base 20, including instructions for left-handed and right-handed players alike. Each method will rely on the target line 29, or an imaginary line that intersects the ball 11, hole, and striking spot of the ball. In an alternative embodiment, several color combinations may be used for separate methods.

The alignment method comprises placing the base perpendicular to the target line, with the front face towards the hole. Three elongated rods 40 are placed into the alignment apertures on the front face in order to assist in finishing through the target and following the correct path. The first elongated rod will placed in an alignment aperture corresponding to the feet of the golfer, while the second and third are positioned in either side of the golf ball. A gap between the first and second elongated rods may be adjusted depending on the type of stance or club being used, or depending on the height of the golfer. Furthermore, the gap between the second and third elongated rods can be adjusted, where an amateur golfer may use alignment apertures one and nine while a professional golfer may use alignment apertures one and seven to narrow the gap. Once placed into the apertures, all elongated rods are parallel to the target line and perpendicular to the golfer's feet. While the above demonstrates a typical configuration, all elongated rod placements can be adjusted for golfers of different heights, styles, and comforts.

In an alternative embodiment, the first three elongated rods are used as they are in the alignment method, and a fourth elongated rod is placed into an aiming aperture on the top face. The fourth elongated rod extends vertically in between the second and third elongated rods, and should be in line with the golf ball and target line. The golfer will then stand behind the fourth elongated rod and use it to align the base and alignment elongated rods to ensure the shot is following the desired target line.

In a further alternative embodiment, the second and third elongated rods are used as they are in the alignment method, and two additional elongated rods are placed into the ground directly in front of these elongated rods. For example, if alignment apertures 1 and 9 are used for the first two alignment elongated rods, two additional elongated rods are planted into the ground in a position aligned a few feet in front of alignment apertures 1 and 9. When struck, the ball will travel through the elongated rods so long as the shot follows the target line. This method may further assist the golfer in aligning his or her shot by providing target at a distance in front of them.

The swing path check method comprises attaching the first two elongated rods as they are used in the alignment method. Afterword, the first rectangular connector is positioned onto the second elongated rod, and the second rectangular connector is positioned on the third elongated rod. The first and second tapered foam members are then attached to the first and second connectors, respectively, using two connecting rods to hold them into place. The connectors and foam members are positioned such that during a back swing and follow through, if the swing is not aligned properly, the foam members will be struck and will provide an indication that the swing is out of alignment. In an alternative embodiment, magnets of opposing polarity are placed within the foam members and connectors, such that the foam members will remain in their desired position regardless of weather conditions.

The draw/fade method comprises attaching the first rectangular connector to the first elongated rod between the rod and the golfer's feet to open or close the golfer's stance. For example, when the connector is positioned between the golfer's left foot and the first elongated rod, the user's stance will be open and will then be intentionally misaligned with the target line. Conversely, if the connector is positioned between the golfer's right foot and the elongated rod, the user's stance will be closed and then be intentionally misaligned with the target line. This will help to add curvature to the path of the ball when struck.

The swing plane method comprises placing the base perpendicular to the target line, and inserting an elongated rod through the front aperture for stability. Two additional elongated rods are placed in the backswing aperture on the top face such that they are parallel and extend at an angle between 30° and 60° towards the golfer. The two elongated rods define a swing space, where a correctly aligned backswing will not come in contact with the elongated rods and an incorrectly aligned backswing will strike the elongated rods. In an alternative embodiment, several additional elongated rods may be placed into the alignment apertures as described in the alignment method for aligning the shot with the target line.

The chipping plane method is similar to the swing plane method, but is intended for chip shots. The first elongated rod is placed through the front aperture for stability, and a second elongated rod is placed into one of the backswing apertures, such that it extends at an angle between 30° and 60° towards the golfer. A third elongated rod is placed into a chipping aperture opposite the side of the backswing aperture such that it extends at an angle between 30° and 60° towards toward the rear face and away from the golfer. The second and third elongated rods define a chipping space, where a correctly aligned chip shot will not come in contact with the elongated rods and an incorrectly aligned chip shot will strike the elongated rods. In an alternative embodiment, several additional elongated rods may be placed into the alignment apertures as described in the alignment method for aligning the shot with the target line.

The head alignment method comprises placing the base perpendicular to the target line, with a first elongated rod placed through the front aperture for stability. A second and third elongated rods are combined with a rectangular connector to double their length, with the second elongated rod attaching to one of the backswing apertures. A positioning ball is then attached to the end of the third elongated rod. When configured in this manner, the second and third elongated rods will extend past the end of the base. The golfer will then position themselves such that their head rests against the positioning ball. During their stroke, the golfer must ensure that their head is near the positioning ball (half an inch), preventing movement back and forth, and thus stabilizing their shot. Alternatively, a fourth elongated rod may extend vertically from an aiming aperture and throughout the connector for additional stability.

The anti-sway method is similar to the head alignment method, but the positioning ball will rest against the golfer's body instead of the head. The anti-sway method comprises placing the base perpendicular to the target line, with a first elongated rod placed through the front aperture for stability. A second elongated rod will be inserted into one of the backswing apertures, with a connector attached to its open end. The positioning ball is then attached to the connector with a connector rod. The golfer will then position themselves such that their body rests against the positioning ball. During their stroke, the golfer must ensure that their body is near the ball (half an inch), preventing movement left and right, and thus stabilizing their swing.

The inside approach method comprises placing the base parallel to the target line, with a first elongated rod, connecting rod, or combination rod placed through the front aperture for stability without interfering with the golf ball. A second elongated rod is inserted into the top aperture such that it extends at an angle between 30° and 60° towards the golfer. Here, the second elongated rod defines an upper limit for a golf swing. If a swing is out of alignment, the second elongated rod will be struck, indicating an error in swing mechanics.

The putting alignment method comprises placing the base parallel to the target line, with the front face perpendicular to the ground. A first elongated rod, connecting rod, or combination rod will be placed into the front aperture, with a rectangular connector attached to first elongated rod nearest the golfer. A second elongated rod will travel through the rectangular connector perpendicular to the first elongated rod and parallel to the base. The golfer will then align their feet with the second elongated rod and keep their back straight, consequently striking the ball along the target line using a straight back-straight forward stroke. Alternatively, the golfer may place their own arc on the opposite side of the ball and parallel to the base and target line. When using the arc, they will be aligned as before, but their stroke will now have an arched path.

In an alternative embodiment, the alignment method can be used without the base, where the first elongated rod is positioned along the golf aim line with a rectangular connector at its center. A second elongated rod is then inserted into the rectangular connector such that the second elongated rod is perpendicular to the first elongated rod, forming a 'T' shape. The golfer will position their feet on either side of the second elongated rod and position the golf ball and club on the opposing side of the first elongated rod and first rectangular connector to assist in aiming their golf swing.

In yet a further alternative embodiment, the elongated rods may be replaced with a plurality of controlled-distance lasers build into the base, which will replicate all angles, positions, and lengths of the original elongated rods as used in the above methods. Here, the lasers can detect whether a club swing comes into contact with the trajectory of the laser. When this occurs, the base will notify the user of an improper swing with a sound or alert. In an even further embodiment, multi-directional lasers can be used to further adjust angles, distances, and lengths.

While the above description contains specific details regarding certain elements, sizes, and other teachings, it is understood that embodiments of the invention or any combination of them may be practiced without these specific details. Specifically, although certain colors and markings are designated in the above embodiments and figures, any colors and markings may be used. These details should not be construed as limitations on the scope of any embodiment, but merely as exemplifications of the presently preferred embodiments. In other instances, well known structures, elements, and techniques have not been shown to clearly explain the details of the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A golf aid comprising:

a rectangular elongated hollow body having a proximal and distal end, said body closed on its proximal end and open on its distal end, said body having opposing parallel front and rear faces and opposing parallel top and bottom faces, said front, rear, top, and bottom faces having a plurality of apertures; and a plurality of elongated rods adapted to fit within said apertures and adapted to be stored within said hollow body;

wherein a golfer will insert said plurality of elongated rods into said plurality of apertures in a predetermined configuration to aim and align a golf swing.

2. The golf aid of claim 1, wherein said plurality of apertures further comprise:

a front aperture positioned at the center of said front face and continuing through said front and rear faces; and two sets of 20 alignment apertures, each set positioned on opposing sides of said front aperture.

3. The golf aid of claim 2, wherein said plurality of apertures further comprise:

a top aperture positioned at the center of said top face and having an angle of incidence between 30° and 60° towards the front face;

two pairs of backswing apertures, each pair positioned on opposing sides of said top aperture, each backswing aperture having an angle of incidence between 30° and 60° towards said top aperture;

two pairs of aiming apertures, each set positioned on opposing sides of said top aperture;

two chipping apertures positioned on opposing sides of said top aperture, each chipping aperture having an angle between 30° and 60° towards said rear face; and two golf tee apertures positioned on opposing sides of said top aperture, each golf tee aperture continuing through said top and bottom faces and adapted for driving a pair of golf tees through said elongated body and into the ground for stability.

4. The golf aid of claim 3, wherein said plurality of apertures further comprise:

a first color corresponding with said alignment and aiming apertures;

a second color corresponding with said backswing apertures;

a third color corresponding with said chipping apertures and a subset of said alignment apertures;

a fourth color corresponding with said golf tee apertures; and a fifth color corresponding with said front and top apertures.

5. The golf aid of claim 3, wherein said apertures are symmetrical about a line of symmetry through the center of said elongated body.

6. The golf aid of claim 3, wherein said plurality of elongated rods further comprise:

four alignment rods;

two connecting rods; and one combination rod.

7. The golf aid of claim 6, further comprising:

a pair of rectangular connectors having a plurality of through holes adapted to receive said elongated rods;

a pair of tapered foam members adapted to connect to said rectangular connectors with said connecting rods; and a positioning ball adapted to connect to said elongated rods or said rectangular connectors with said connecting rods.

8. A method of using a golf aid, comprising:

positioning a hollow rectangular elongated body perpendicular to a golf target line, said body having opposing parallel front and rear faces and opposing parallel top and bottom faces;

inserting a first of a plurality of elongated rods into a first alignment aperture positioned along said front face of said elongated body such that said first elongated rod is positioned perpendicular to the golfer's feet and parallel to the target line;

inserting a second of a plurality of elongated rods into a second alignment aperture positioned along said front face of said elongated body such that said second elongated rod is parallel with the golf target line and positioned between the golfer and the golf ball; and inserting a third of a plurality of elongated rods into a third alignment aperture positioned along said front face of said elongated body such that said third elongated rod is parallel with the golf target line and positioned opposite said golf ball.

9. A method of claim 8, further comprising:

inserting a fourth of a plurality of elongated rods into an aiming aperture positioned along said top face of said elongated body such that said fourth elongated rod extends vertically between said second and third elongated rods parallel to the target line.

10. A method of claim 8, further comprising:

inserting said first of a plurality of elongated rods vertically into the ground in a line extending from said second elongated rod; and inserting a fourth of a plurality of elongated rods vertically into the ground in a line extending from said third elongated rod;

wherein the golf ball will travel between said first and fourth elongated rods when struck properly.

11. A method of claim 8, further comprising:

attaching a first rectangular connector having a plurality of through holes along said second elongated rod;

attaching a second rectangular connector having a plurality of through holes along said third elongated rod; and attaching a first and second tapered foam member to said first and second rectangular connectors;

wherein said first and second foam members will be struck if a golf swing is out of alignment.

12. A method of claim 8, further comprising:

attaching a first rectangular connector having a plurality of through holes along said first elongated rod;

wherein said first rectangular connector is positioned between said first elongated rod and either of the golfer's feet, causing the golfer to open or close their stance.

13. A method of claim 8, further comprising:

inserting said first of a plurality of elongated rods into a front through aperture positioned along the center of said front face of said elongated body such that said first elongated rod provides stability to said elongated body;

inserting said second of a plurality of elongated rods into a first backswing aperture positioned along said top face of said elongated body such that said second elongated rod extends at an angle between 30° and 60° towards the golfer; and inserting said third of a plurality of elongated rods into a second backswing aperture positioned along said top face of said elongated body such that said third elongated rod extends at an angle between 30° and 60° towards the golfer;

wherein said second and third elongated rods define a swing space for a golf backswing, and wherein said second and third elongated rods will be struck if a golf backswing is out of alignment.

14. A method of claim 13, further comprising:

inserting said third of a plurality of elongated rods into a first chipping aperture positioned along said top face of said elongated body such that said third elongated rod extends at an angle between 30° and 60° towards said rear face;

wherein said second and third elongated rods define a chipping space for a golf chip shot, and wherein said second and third elongated rods will be struck if a golf chip shot is out of alignment.

15. A method of claim 13, further comprising:

attaching a first rectangular connector having a plurality of through holes onto the end of said second elongated rod;

inserting said third of a plurality of elongated rods into said rectangular connector such that said third elongated rod extends in the same direction as said first elongated rod; and attaching a positioning ball onto the end of said third elongated rod;

wherein the golfer positions their head adjacent to said positioning ball for head alignment.

16. A method of claim 15, further comprising:

inserting a fourth of a plurality of elongated rods into an aiming aperture positioned along said top face of said elongated body such that said fourth elongated rod extends vertically;

wherein said fourth elongated rod travels through said first rectangular connector for additional stability.

17. A method of claim 13, further comprising:

removing said third elongated rod;

attaching a first rectangular connector having a plurality of through holes onto the end of said second elongated rod; and attaching a positioning ball onto said first rectangular connector;

wherein said positioning ball is positioned adjacent to the golfer during their golf swing, and wherein any loss of contact or excessive contact with said position ball indicates a golf swing that is out of alignment.

18. A method of claim 8, further comprising:

positioning said elongated body parallel with the golf target line;

inserting said first of a plurality of elongated rods into a front through aperture positioned along the center of said front face of said elongated body such that said first elongated rod provides stability to said elongated body without interfering with the golf ball;

inserting said second of a plurality of elongated rods into a top aperture positioned along the center of said top face of said elongated body such that said second elongated rod extends at an angle between 30° and 60° towards the golfer; and removing said third elongated rod;

wherein said second elongated rod defines an upper limit for a golf swing, and wherein said second elongated rod will be struck if a golf swing is out of alignment.

19. A method of claim 18, further comprising:

attaching a first rectangular connector having a plurality of through holes onto said first elongated rod; and inserting said second of a plurality of elongated rods through said first rectangular connector such that said second elongated rod is parallel with said elongated body;

wherein the golfer will align their feet with said second elongated rod and align their golf ball with said elongated body for use with a putting shot.

* * * * *